US005660374A

United States Patent [19]

Dayberry

[11] Patent Number: 5,660,374

[45] Date of Patent: Aug. 26, 1997

[54] APPARATUS FOR INHIBITING GROWTH OF VEGETATION BENEATH A FENCE

[76] Inventor: John A. Dayberry, 7502 E. 196th St., Nobelsville, Ind. 46060

[21] Appl. No.: 600,091

[22] Filed: Feb. 12, 1996

[51] Int. Cl.[6] ..... E04H 17/06

[52] U.S. Cl. ..... 256/1; 256/32; 47/33

[58] Field of Search ..... 256/1, 32, 33, 256/34; 285/4, 177; 52/102; 47/33

[56] References Cited

U.S. PATENT DOCUMENTS

| | | | |
|---|---|---|---|
| 3,384,351 | 5/1968 | Turner, Jr. | 256/32 |
| 3,393,897 | 7/1968 | Wright | 256/32 |
| 3,515,373 | 6/1970 | Abbe | 256/32 |
| 3,713,624 | 1/1973 | Niemann | 256/32 |
| 3,768,780 | 10/1973 | Cowles et al. | 256/32 X |
| 3,806,096 | 4/1974 | Eccleston et al. | 256/32 |
| 3,822,864 | 7/1974 | Keys | 256/32 |
| 3,995,888 | 12/1976 | McIlroy | 285/4 |
| 4,497,472 | 2/1985 | Johnson | 256/32 |
| 4,595,175 | 6/1986 | Kauffman et al. | 256/32 X |
| 4,690,382 | 9/1987 | Koperdak | 256/32 X |
| 4,903,947 | 2/1990 | Groves | 256/32 |
| 5,039,065 | 8/1991 | Denton | 256/32 X |
| 5,178,369 | 1/1993 | Syx | 256/32 |

*Primary Examiner*—Harry C. Kim

*Attorney, Agent, or Firm*—Richard L. Miller, P.E.

[57] ABSTRACT

An underfence vegetation inhibiting apparatus that includes a long section elongated substantially U-shaped central portion and a pair of long section elongated thin convex arcuate shaped portions. The long section elongated substantially U-shaped central portion has an outer surface with ends and defines a slot for receiving the bottom of the section of fencing disposable intermediate the pair of fence posts. The long section elongated substantially U-shaped central portion further has a long section elongated substantially flat thin bottom with sides and an entire length, a pair of long section elongated substantially flat thin sides extending upwardly along the entire length of the sides of the long section elongated substantially flat thin bottom. Each of the pair of long section elongated substantially flat thin sides terminate in a long section elongated substantially flat thin side free end with an entire length. Each of the pair of long section elongated thin convex arcuate shaped portions have a lower surface with ends and extend outwardly downwardly along the entire length of each the long section elongated substantially flat thin side free end of the pair of long section elongated substantially flat thin sides of the long section elongated substantially U-shaped central portion. Each long section elongated thin convex arcuate shaped portion terminates in a long section free end. And, a short connecting section is provided to fill the gaps produced where the long section meets the fence poles.

14 Claims, 3 Drawing Sheets

APPARATUS FOR INHIBITING GROWTH OF VEGETATION BENEATH A FENCE

BACKGROUND OF THE INVENTION

The present invention relates to an apparatus for inhibiting the growth of vegetation beneath a fence. More particularly, the present invention relates to an underfence vegetation inhibiting apparatus that includes a long section elongated substantially U-shaped central portion and a long section elongated thin convex arcuate shaped portion that extends downwardly from the long section elongated substantially U-shaped central portion.

In the maintenance of lawns the growth of vegetation, such as grass, adjacent to and directly beneath fences has long posed a problem because of the difficulty in keeping this vegetation trimmed. Often trimming of the vegetation beneath the fence involves special equipment and/or labor that is difficult to perform even with special equipment and in most situations the vegetation must be trimmed by hand. Special chemical solutions intended to inhibit the growth of vegetation in such areas have been proposed but have failed to find general acceptance mostly because of the unsightly appearance of the ground area immediately beneath the fence as a result of using such special chemical solutions.

Numerous innovations for inhibiting the growth of vegetation beneath a fence have been provided in the prior art that will be described. However, even though these innovations may be suitable for the specific individual purposes to which they address, they differ from the present invention in that they do not teach an underfence vegetation inhibiting apparatus that includes a long section elongated substantially U-shaped central portion and a long section elongated thin convex arcuate shaped portion that extends downwardly from the long section elongated substantially U-shaped central portion.

For example, U.S. Pat. No. 3,806,096 to Eccleston et al. teaches a barrier that includes a shell that telescopically receives a core member. The shell has a longitudinally disposed slot at one end adapted to receive the lower portion of a vertical post of the fence.

Another example, U.S. Pat. No. 3,822,864 to Keys teaches a weed barrier for use in combination with fencing that includes nestable and telescopic channel shaped members are disposed and secured along the ground and beneath intermediate each of the fence posts.

Still another example, U.S. Pat. No. 4,497,472 to Johnson teaches a vegetation blocking fence edging assembly that includes fence structure, a plurality of elongated edging strips, and a plurality of fence pot edging structures. The edging strip has U-shaped slots at its longitudinal ends. The edging strip includes a longitudinally extending, generally J-shaped portion made up of a U-shaped portion.

Yet another example, U.S. Pat. No. 4,903,947 to Groves teaches a fence vegetation barrier that includes an arcuate shaped base member and an upstanding leg formed either centrally or laterally with the base member. The leg is connected by a living hinge to the base member.

Finally, still yet another example, U.S. Pat. No. 5,178,368 to Syx teaches a fence vegetation barrier that includes a solid triangular shaped body portion and a pair of parallel legs extending upwardly from the base and defining a slot therebetween.

It is apparent that numerous innovations for inhibiting the growth of vegetation beneath a fence have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide an apparatus for inhibiting the growth of vegetation beneath a fence that avoids the disadvantages of the prior art.

Another object of the present invention is to provide an apparatus for inhibiting the growth of vegetation beneath a fence that is simple and inexpensive to manufacture.

Still another object of the present invention is to provide an apparatus for inhibiting the growth of vegetation beneath a fence that is simple to use.

Yet another object of the present invention is to provide an apparatus for inhibiting the growth of vegetation beneath a fence that is a sun blocking device which is installed under a fence to prevent grass and weeds from growing four inches from either side of the fence.

Still yet another object of the present invention is to provide an apparatus for inhibiting the growth of vegetation beneath a fence that is prevented from vertical movement by the wind.

Yet still another object of the present invention is to provide an apparatus for inhibiting the growth of vegetation beneath a fence that eliminates the need for hand trimming.

Still yet another object of the present invention is to provide an apparatus for inhibiting the growth of vegetation beneath a fence that allows a regular lawn mower to easily mow along the fence line.

Yet still another object of the present invention is to provide an apparatus for inhibiting the growth of vegetation beneath a fence that will greatly improve the appearance of a fence line and eliminate the need to hand trim along the fence line reducing time and effort.

Still yet another object of the present invention is to provide an apparatus for inhibiting the growth of vegetation beneath a fence that prevents sunlight from reaching vegetation beneath the fence so that photosynthesis can not occur and the vegetation dies.

Yet still another object of the present invention is to provide an apparatus for inhibiting the growth of vegetation beneath a fence that can be installed under a fence already in place.

Briefly stated, still yet another object of the present invention is to provide an apparatus for inhibiting the growth of vegetation beneath a fence that includes a long section elongated substantially U-shaped central portion and a pair of long section elongated thin convex arcuate shaped portions.

Yet still another object of the present invention is to provide an apparatus for inhibiting the growth of vegetation beneath a fence wherein the long section elongated substantially U-shaped central portion has an outer surface with ends and defines a slot for receiving the bottom of a section of fencing disposable intermediate a pair of fence posts.

Still yet another object of the present invention is to provide an apparatus for inhibiting the growth of vegetation beneath a fence wherein the long section elongated substantially U-shaped central portion further has a long section elongated substantially flat thin bottom with sides, an entire length, and a pair of long section elongated substantially flat thin sides extending upwardly along the entire length of the sides of the long section elongated substantially flat thin bottom.

Yet still another object of the present invention is to provide an apparatus for inhibiting the growth of vegetation beneath a fence wherein each of the pair of long section elongated substantially flat thin sides terminate in a long section elongated substantially flat thin side free end with an entire length.

Still yet another object of the present invention is to provide an apparatus for inhibiting the growth of vegetation beneath a fence wherein each of the pair of long section elongated thin convex arcuate shaped portions have a lower surface with ends and extends outwardly downwardly along the entire length of each long section elongated substantially flat thin side free end of the pair of long section elongated substantially flat thin sides of the long section elongated substantially U-shaped central portion.

Yet still another object of the present invention is to provide an apparatus for inhibiting the growth of vegetation beneath a fence wherein each long section elongated thin convex arcuate shaped portion terminates in a long section free end.

Still yet another object of the present invention is to provide an apparatus for inhibiting the growth of vegetation beneath a fence wherein each long section elongated thin convex arcuate shaped portion extends to a point generally below the long section elongated substantially flat thin bottom of the long section elongated substantially U-shaped central portion.

Yet still another object of the present invention is to provide an apparatus for inhibiting the growth of vegetation beneath a fence wherein the long section free end is beveled so that smooth communication with the vegetation alongside the area covered by the underfence vegetation inhibiting apparatus is provided for better water runoff.

Still yet another object of the present invention is to provide an apparatus for inhibiting the growth of vegetation beneath a fence wherein each long section elongated thin convex arcuate shaped portion extends outwardly downwardly along the entire length of each long section elongated substantially flat thin side free end of the pair of long section elongated substantially flat thin sides of the long section elongated substantially U-shaped central portion at an approximate angle of 15 degrees so as to provide a spring-type loading action when the apparatus for inhibiting the growth of vegetation beneath a fence is sandwiched between the section of vegetation and the section of fencing so that the apparatus for inhibiting the growth of vegetation beneath a fence is held in place therebetween and prevented from vertical movement due to wind.

Yet still another object of the present invention is to provide an apparatus for inhibiting the growth of vegetation beneath a fence wherein each long section elongated thin convex arcuate shaped portion is integrally formed with the long section elongated substantially U-shaped central portion.

Still yet another object of the present invention is to provide an apparatus for inhibiting the growth of vegetation beneath a fence wherein each long section elongated thin convex arcuate shaped portion is integrally formed with the long section elongated substantially U-shaped central portion by extrusion.

Yet still another object of the present invention is to provide an apparatus for inhibiting the growth of vegetation beneath a fence wherein each long section elongated thin convex arcuate shaped portion is integrally formed with the long section elongated substantially U-shaped central portion by extrusion of one half inch green weather resistant vinyl in lengths of ten feet and widths of eight inches so that each long section elongated thin convex arcuate shaped portion and the long section elongated substantially U-shaped central portion blend in with the surrounding turf and are totally maintenance free.

Still yet another object of the present invention is to provide an apparatus for inhibiting the growth of vegetation beneath a fence wherein the ends of the outer surface of the long section elongated substantially U-shaped central portion and the ends of the lower surface of each long section elongated thin convex arcuate shaped portion have a plurality of laterally disposed long section break-off slots so that the length of the underfence vegetation inhibiting apparatus can be decreased if the space intermediate the pair of fence posts mandates.

Yet still another object of the present invention is to provide an apparatus for inhibiting the growth of vegetation beneath a fence wherein the long section elongated substantially flat thin bottom of the long section elongated substantially U-shaped central portion has at least one long section bottom spike hole and an aluminum spike passable through at least one long section bottom spike hole and securable in the ground underneath.

Still yet another object of the present invention is to provide an apparatus for inhibiting the growth of vegetation beneath a fence that further includes a short section utilized to cover a gap formed at a fence post when the underfence vegetation inhibiting apparatus is utilized with more fence posts than the pair of fence posts.

Yet still another object of the present invention is to provide an apparatus for inhibiting the growth of vegetation beneath a fence wherein the short section has a short section elongated substantially U-shaped central portion having an outer surface with ends and defines a slot for receiving the bottom of the section of fencing disposable intermediate the pair of fence posts and received by the slot of the long section elongated substantially U-shaped central portion.

Still yet another object of the present invention is to provide an apparatus for inhibiting the growth of vegetation beneath a fence wherein the short section elongated substantially U-shaped central portion further has a short section elongated substantially flat thin bottom with sides, an entire length, and a pair of short section elongated substantially flat thin sides extend upwardly along the entire length of the sides of the short section elongated substantially flat thin bottom.

Yet still another object of the present invention is to provide an apparatus for inhibiting the growth of vegetation beneath a fence wherein each pair of short section elongated substantially flat thin sides terminate in a short section elongated substantially flat thin side free end with an entire length.

Still yet another object of the present invention is to provide an apparatus for inhibiting the growth of vegetation beneath a fence wherein the short section further has a pair of short section elongated thin convex arcuate shaped portions.

Yet still another object of the present invention is to provide an apparatus for inhibiting the growth of vegetation beneath a fence wherein each of the pair of short section elongated thin convex arcuate shaped portions have a lower surface with ends and extend outwardly downwardly along the entire length of each short section elongated substantially flat thin side free end of the pair of short section elongated substantially flat thin sides of the short section elongated substantially U-shaped central portion.

Still yet another object of the present invention is to provide an apparatus for inhibiting the growth of vegetation beneath a fence wherein each short section elongated thin convex arcuate shaped portion terminates in a short section free end.

Yet still another object of the present invention is to provide an apparatus for inhibiting the growth of vegetation beneath a fence wherein each short section elongated thin convex arcuate shaped portion extends to a point generally below the short section elongated substantially flat thin bottom of the short section elongated substantially U-shaped central portion.

Still yet another object of the present invention is to provide an apparatus for inhibiting the growth of vegetation beneath a fence wherein the short section free end is beveled so that smooth communication with the vegetation alongside the area covered by the underfence vegetation inhibiting apparatus is provided for better water runoff.

Yet still another object of the present invention is to provide an apparatus for inhibiting the growth of vegetation beneath a fence wherein each short section elongated thin convex arcuate shaped portion extends outwardly downwardly along the entire length of the each the short section elongated substantially flat thin side free end of the pair of short section elongated substantially flat thin sides of the short section elongated substantially U-shaped central portion at an approximate angle of 15 degrees so as to provide a spring-type loading action when the underfence vegetation inhibiting apparatus is sandwiched between the section of vegetation and the section of fencing so that the apparatus for inhibiting the growth of vegetation beneath a fence is held in place therebetween and prevented from vertical movement due to wind.

Still yet another object of the present invention is to provide an apparatus for inhibiting the growth of vegetation beneath a fence wherein each short section elongated thin convex arcuate shaped portion is integrally formed with the short section elongated substantially U-shaped central portion.

Yet still another object of the present invention is to provide an apparatus for inhibiting the growth of vegetation beneath a fence wherein each short section elongated thin convex arcuate shaped portion is integrally formed with the short section elongated substantially U-shaped central portion by extrusion.

Still yet another object of the present invention is to provide an apparatus for inhibiting the growth of vegetation beneath a fence wherein each short section elongated thin convex arcuate shaped portion is integrally formed with the short section elongated substantially U-shaped central portion by extrusion of one half inch green weather resistant vinyl in lengths of two feet and widths of eight inches so that each short section elongated thin convex arcuate shaped portion and the short section elongated substantially U-shaped central portion blend in with the surrounding turf and are totally maintenance free.

Yet still another object of the present invention is to provide an apparatus for inhibiting the growth of vegetation beneath a fence wherein the ends of the outer surface of the short section elongated substantially U-shaped central portion and the ends of the lower surface of each short section elongated thin convex arcuate shaped portion have a plurality of laterally disposed short section break-off slots so that the length of the short section can be decreased if necessary.

Still yet another object of the present invention is to provide an apparatus for inhibiting the growth of vegetation beneath a fence wherein the short section elongated substantially flat thin bottom of the short section elongated substantially U-shaped central portion has a centrally disposed short section bottom aperture.

Yet still another object of the present invention is to provide an apparatus for inhibiting the growth of vegetation beneath a fence wherein one of said pair of short section elongated thin convex arcuate shaped portion and a respective one of the pair of short section elongated substantially flat sides have a continuous laterally disposed short section separation cut that extends from a respective short section free end and opens into the centrally disposed short section bottom aperture.

Finally, still yet another object of the present invention is to provide a method of utilizing an apparatus for inhibiting the growth of vegetation beneath a fence that includes the steps of placing long sections of the underfence vegetation inhibiting apparatus on the sections of vegetation to be covered and intermediate pairs of fence posts, twisting short sections of the underfence vegetation inhibiting apparatus so that laterally disposed short section separation cuts of the short sections separate, placing the twisted short sections around each fence post of the pairs of fence posts with a centrally disposed short section bottom apertures of the short sections receiving each fence post, untwisting the short sections, lowering the short sections onto the ends of the long sections so that long section elongated substantially U-shaped central portions of the long sections receive the short section elongated substantially U-shaped central portions of the short sections cover the gaps formed between the fence posts and the ends of the long sections, and receiving the bottom of fencing disposed intermediate the pairs of fence posts by the long section elongated substantially U-shaped central portions and the short section elongated substantially U-shaped central portions.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

Figure 3:
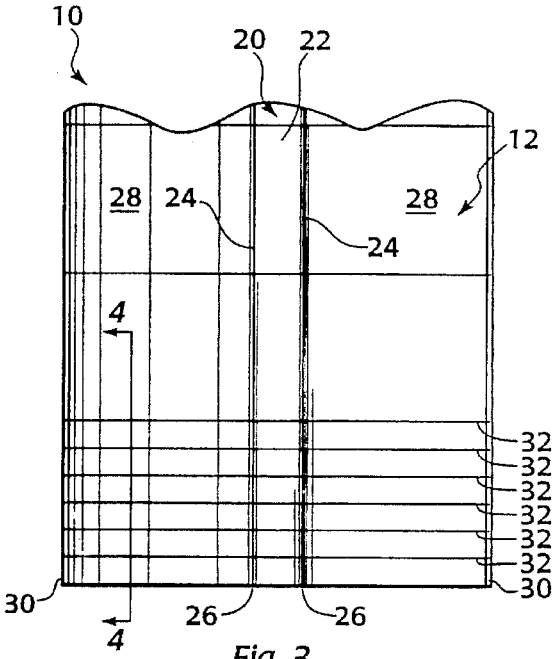
FIG. 3 is a diagrammatic bottom plan view, with parts broken away, taken the direction of arrow 3 in FIG. 2.

LIST OF REFERENCE NUMERALS UTILIZED IN THE DRAWING 10 apparatus for inhibiting the growth of vegetation beneath a fence of the present invention 12 long section 14 section of vegetation 16 pair of fence posts 18 section of fencing 20 long section elongated substantially U-shaped central portion 22 long section elongated substantially flat thin bottom 24 pair of long section elongated substantially flat thin sides 26 long section elongated substantially flat thin side free end 28 long section elongated thin convex arcuate shaped portion 30 long section beveled free end 32 plurality of long section break-off slots 34 optional short section 36 short section elongated substantially U-shaped central portion 38 short section elongated substantially flat thin bottom 39 centrally disposed short section bottom aperture 40 pair of short section elongated substantially flat thin sides 41 laterally disposed short section separation cut 42 short section elongated substantially flat thin side free end 44 short section elongated thin convex arcuate shaped portion 46 short section beveled free end 48 aluminum spikes 50 long section bottom spike holes 52 water.

DETAILED DESCRIPTION OF THE PREFERRED EMBODIMENT

Figure 1:
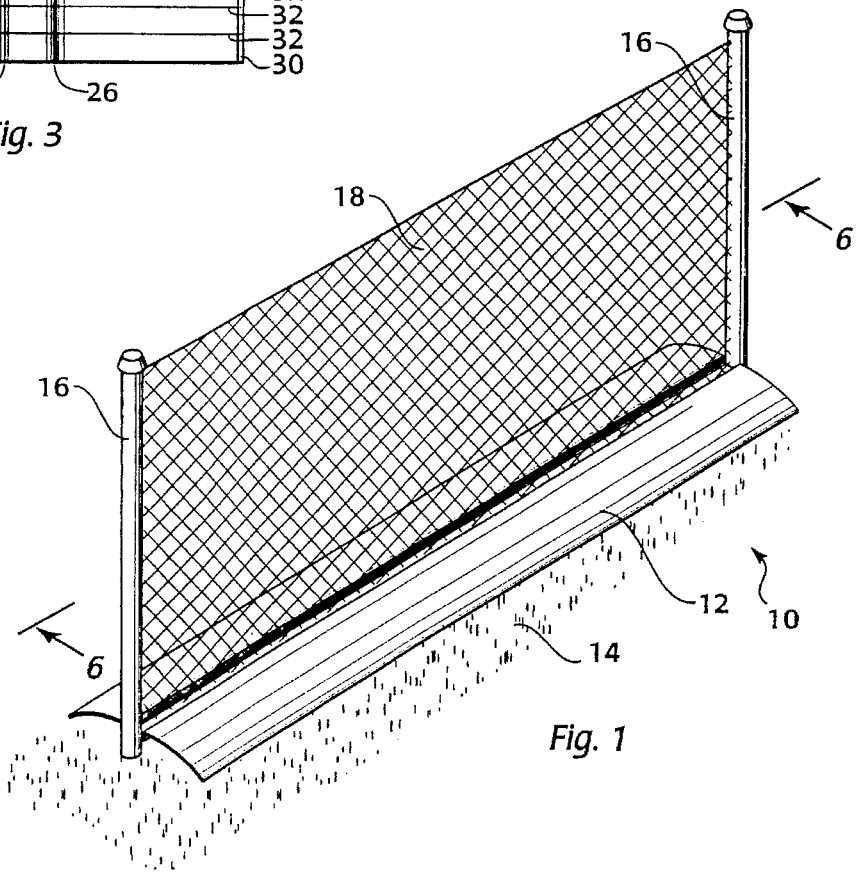
FIG. 1 is a diagrammatic perspective view illustrating a single long section of the present invention in use preventing grass from growing under a fence.

Referring now to the references in which like numerals indicate like parts, and particularly FIG. 1, the apparatus for inhibiting the growth of vegetation beneath a fence of the present invention is shown generally at 10 including a long section 12 that is disposed over a section of vegetation 14, intermediate a pair of fence posts 16, and receiving a section of fencing 18.

Figure 2:
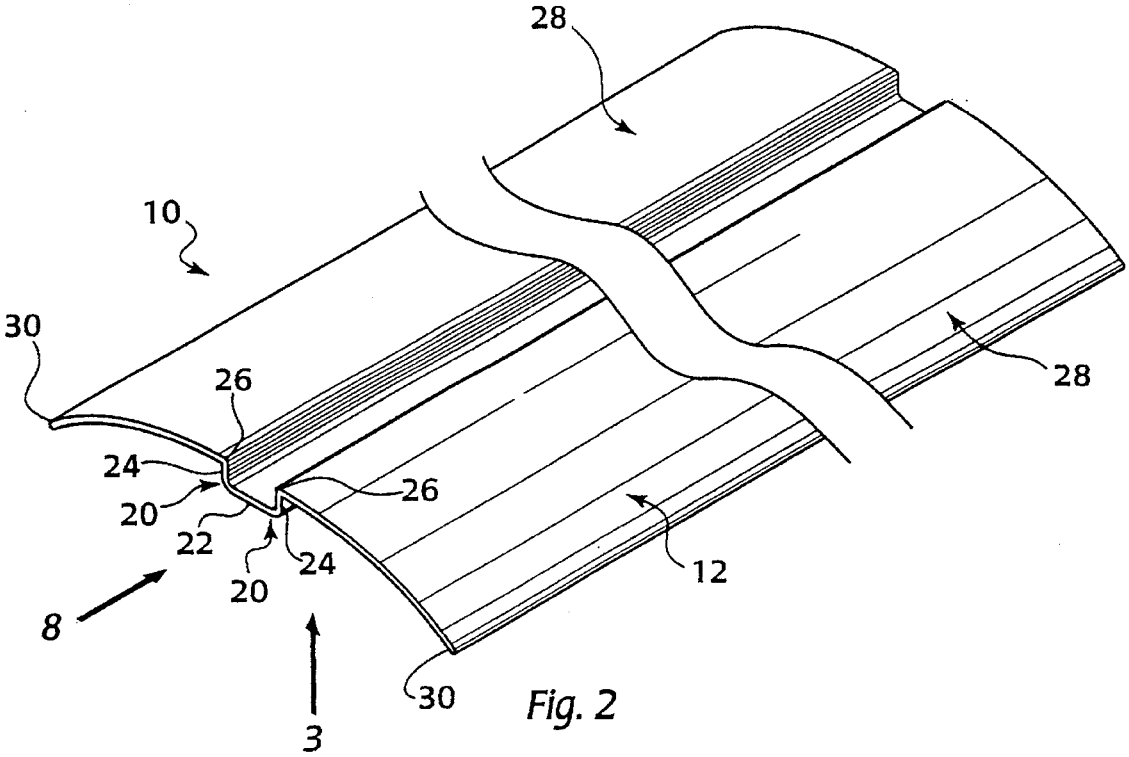
FIG. 2 is a diagrammatic perspective view, with parts broken away, of a long section of the present invention.

The configuration of the long section 12 of the apparatus for inhibiting the growth of vegetation beneath a fence 10 can best be seen in FIGS. 2–4, and as such, will be discussed with reference thereto.

The long section 12 of the apparatus for inhibiting the growth of vegetation beneath a fence 10 includes a long section elongated substantially U-shaped central portion 20 having a long section elongated substantially flat thin bottom 22, a pair of long section elongated substantially flat thin sides 24 extending upwardly along the entire length of the sides of the long section elongated substantially flat thin bottom 22 and each terminating in a long section elongated substantially flat thin side free end 26.

Along section elongated thin convex arcuate shaped portion 28 extends downwardly along the entire length of each long section elongated substantially flat thin side free end 26 of the pair of long section elongated substantially flat thin sides 24 of the long section elongated substantially U-shaped central portion 20 to a point generally below the long section elongated substantially flat thin bottom 22 of the long section elongated substantially U-shaped central portion 20 and terminating in a long section beveled free end 30.

Each long section elongated thin convex arcuate shaped portion 28 extends downwardly along the entire length of each long section elongated substantially flat thin side free end 26 of the pair of long section elongated substantially flat thin sides 24 of the long section elongated substantially U-shaped central portion 20 at an approximate angle of 15 degrees so as to provide a spring loaded action when the long section 12 of the apparatus for inhibiting the growth of vegetation beneath a fence 10 is sandwiched between the section of vegetation 14 and the section of fencing 18 so that the long section 12 of the apparatus for inhibiting the growth of vegetation beneath a fence 10 is held in place therebetween. This spring-type loading prevents vertical movement of the long section 12 of the apparatus for inhibiting the growth of vegetation beneath a fence 10 due to wind.

The long section beveled free end 30 of each long section elongated thin convex arcuate shaped portion 28 of the apparatus for inhibiting the growth of vegetation beneath a fence 10 provides a smooth communication with the vegetation alongside the area covered by the apparatus for inhibiting the growth of vegetation beneath a fence 10 for better water runoff therefrom.

Each long section elongated thin convex arcuate shaped portion 28 is integrally formed with the long section elongated substantially U-shaped central portion 20 by extrusion of one half inch green weather resistant vinyl in lengths of ten feet and widths of 8 inches so that the long section 12 of the apparatus for inhibiting the growth of vegetation beneath a fence 10 blends in with the surrounding turf and are totally maintenance free.

Figure 4:
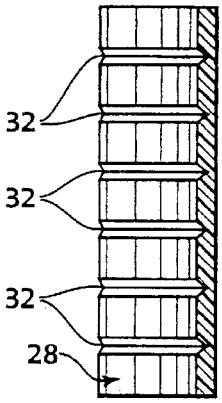
FIG. 4 is a cross sectional view taken on line 4—4 of FIG. 3.

As shown in FIGS. 3 and 4, a plurality of long section break-off slots 32 are disposed laterally along each end of the lower surface of the long section 12 of the apparatus for inhibiting the growth of vegetation beneath a fence 10. The plurality of long section break-off slots 32 allow the length of the long section 12 of the apparatus for inhibiting the growth of vegetation beneath a fence 10 to be decreased if the space intermediate the pair of fence posts 16 mandates such.

Figure 5:
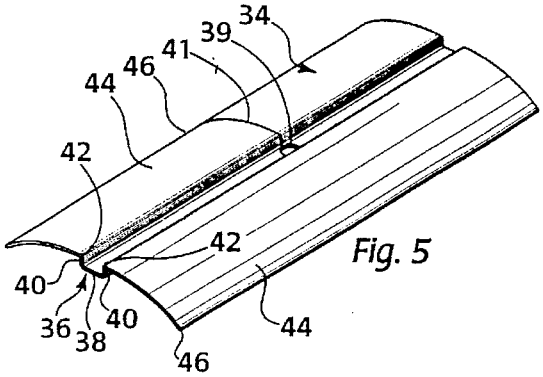
FIG. 5 is diagrammatic perspective view of an optional short section of the present invention.

The configuration of an optional short section 34 of the apparatus for inhibiting the growth of vegetation beneath a fence 10 can best be seen in FIG. 5, and as such, will be discussed with reference thereto.

The optional short section 34 is utilized to cover the gap formed at a fence post when the apparatus for inhibiting the growth of vegetation beneath a fence 10 is utilized to inhibit the growth of vegetation beneath a fence when the fence includes more fence posts than the pair of fence posts 16.

The short section 34 of the apparatus for inhibiting the growth of vegetation beneath a fence 10 includes a short section elongated substantially U-shaped central portion 36 having a short section elongated substantially flat thin bottom 38 with a centrally disposed short section bottom aperture 39, a pair of short section elongated substantially flat thin sides 40 extending upwardly along the entire length of the sides of the short section elongated substantially flat thin bottom 38 and each terminating in a short section elongated substantially flat thin side free end 42.

A short section elongated thin convex arcuate shaped portion 44 extends downwardly along the entire length of each short section elongated substantially flat thin side free end 42 of the pair of short section elongated substantially flat thin sides 40 of the short section elongated substantially U-shaped central portion 36 to a point generally below the short section elongated substantially flat thin bottom 38 of the short section elongated substantially U-shaped central portion 36 and terminating in a short section beveled free end 46.

A laterally disposed short section separation cut 41 extends laterally from one short section beveled free end 46 through the respective short section elongated thin convex arcuate shaped portion 44, through the respective one of the pair of short section elongated substantially flat sides 40, and opens into the centrally disposed short section bottom aperture 39.

Each short section elongated thin convex arcuate shaped portion 44 extends downwardly along the entire length of each short section elongated substantially flat thin side free end 42 of the pair of short section elongated substantially flat thin sides 40 of the short section elongated substantially U-shaped central portion 36 at an approximate angle of 15 degrees so as to provide a spring loaded action when the short section 34 of the apparatus for inhibiting the growth of vegetation beneath a fence 10 is sandwiched between the section of vegetation 14 and the section of fencing 18 so that the short section 34 of the apparatus for inhibiting the growth of vegetation beneath a fence 10 is held in place therebetween. This spring-type loading prevents vertical movement of the short section 34 of the apparatus for inhibiting the growth of vegetation beneath a fence 10 due to wind.

The short section beveled free end 46 of each short section elongated thin convex arcuate shaped portion 44 of the apparatus for inhibiting the growth of vegetation beneath a fence 10 provides a smooth communication with the vegetation alongside the area covered by the apparatus for inhibiting the growth of vegetation beneath a fence 10 for better water runoff thereto.

Each short section elongated thin convex arcuate shaped portion 34 is integrally formed with the short section elongated substantially U-shaped central portion 36 by extrusion of one half inch green weather resistant vinyl in lengths of two feet and widths of 8 inches so that the short section 34 of the apparatus for inhibiting the growth of vegetation beneath a fence 10 blends in with the surrounding turf and are totally maintenance free.

As discussed with reference to FIGS. 3 and 4, supra, a plurality of short section break-off slots (not shown) can be disposed laterally along each end Of the lower surface of the short section 34 of the apparatus for inhibiting the growth of vegetation beneath a fence 10. The plurality of short section break-off slots (not shown) allow the length of the short section 34 of the apparatus for inhibiting the growth of vegetation beneath a fence 10 to be decreased if the space along side each of the pair of fence posts 16 mandates such.

Figure 6:
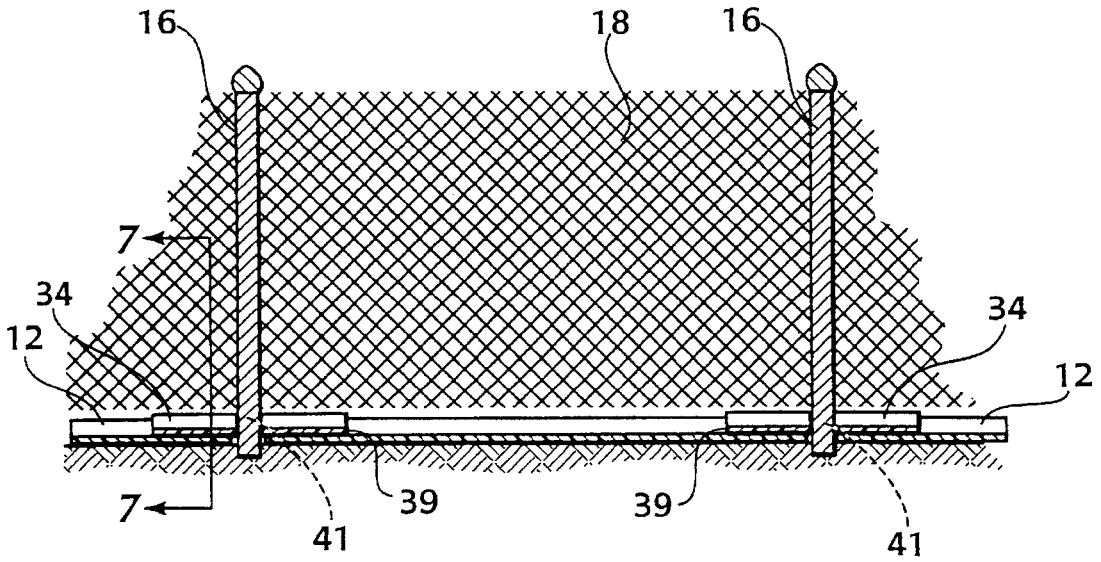
FIG. 6 is a cross sectional view taken on line 6—6 of FIG. 5 of the present invention with both the long and short sections in place.

The method of utilizing the apparatus for inhibiting the growth of vegetation beneath a fence 10 when the bottom of the fencing 18 is close to the ground and more fence posts than the pair of fence posts 16 are used, can best be seen in FIGS. 6 and 7, and as such, will be discussed with reference thereto. Since the bottom of the fencing 18 is close to the ground, the fencing 18 will hold the apparatus for inhibiting the growth of vegetation beneath a fence 10 in place.

The long sections 12 are placed on the sections of vegetation 14 to be covered, intermediate the pairs of fence posts 16.

The short sections 34 are twisted so that the laterally disposed short section separation cuts 41 separate.

The twisted short sections 34 are placed around each fence post of the pairs of fence posts 16 with the centrally disposed short section bottom apertures 39 receiving each fence post of the pairs of fence posts.

The short sections 34 are untwisted.

The short sections 34 are lowered onto the ends of the long sections 12 so that the long section elongated substantially U-shaped central portions 20 receive the short section elongated substantially U-shaped central portions 36 and cover the gaps formed between the fence posts and the ends of the long sections 12.

The short section elongated substantially U-shaped central portions 36 and the long section elongated substantially U-shaped central portions 20 receive and straddle the bottom of the section of fencing 18.

The method of utilizing the apparatus for inhibiting the growth of vegetation beneath a fence 10 when the bottom of the fencing 18 is not close to the ground, and more fence posts than the pair of fence posts 16 are used, can best be seen in FIGS. 6–8, and as such, will be discussed with reference thereto.

The long sections 12 are placed on the sections of vegetation 14 to be covered, intermediate the pairs of fence posts 16.

Aluminum spikes 48 are passed through long section bottom spike holes 50 disposed intermittently along the long section elongated substantially flat thin bottoms 22 of the long section elongated substantially U-shaped central portions 20 of the long sections 12.

The short sections 34 are twisted so that the laterally disposed short section separation cuts 41 separate.

The twisted short sections 34 are placed around each fence post of the pairs of fence posts 16 with the centrally disposed short section bottom apertures 39 receiving each fence post of the pairs of fence posts.

The short sections 34 are untwisted.

The short sections 34 are lowered onto the ends of the long sections 12 so that the long section elongated substantially U-shaped central portions 20 receive the short section elongated substantially U-shaped central portions 36 and cover the gaps formed between the fence posts and the ends of the long sections 12.

The short section elongated substantially U-shaped central portions 36 and the long section elongated substantially U-shaped central portions 20 receive and straddle the bottom of the section of fencing 18.

Figure 8:
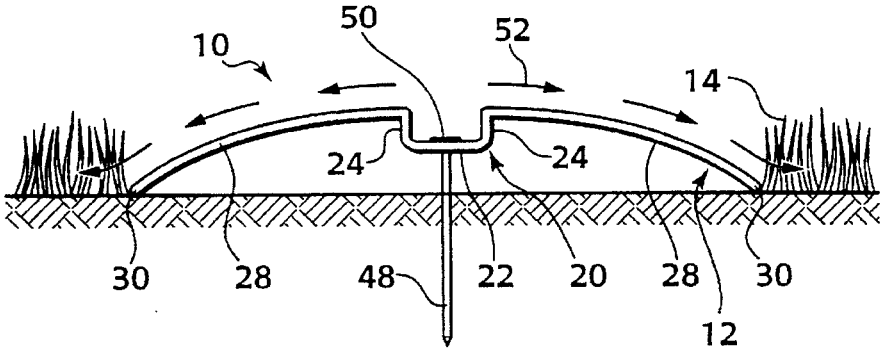
FIG. 8 s a diagrammatic end view taken in the direction of arrow 8 in FIG. 2, illustrating how grass is prevented from growing underneath, and illustrating the use of the optional spikes.
Figure 7:
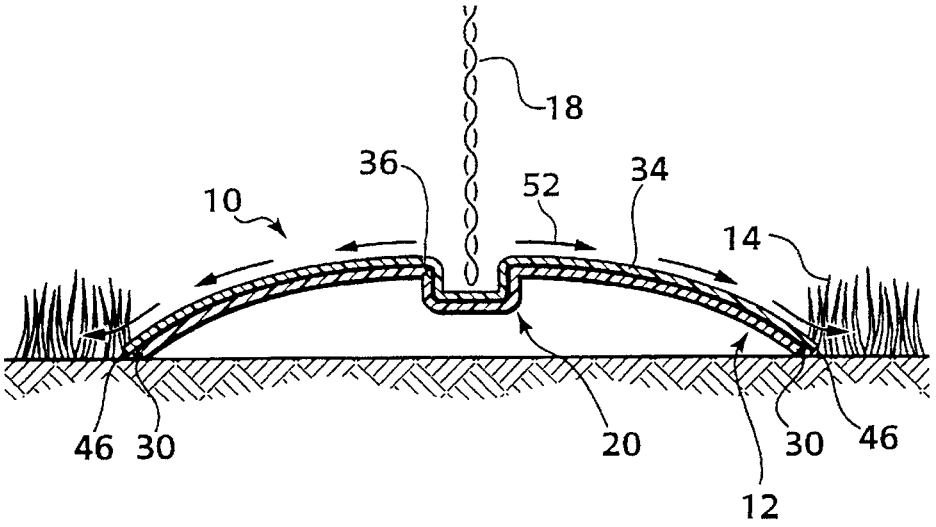
FIG. 7 is a diagrammatic cross sectional taken on line 7—7 in FIG. 6.

As shown in FIGS. 7 and 8, the long section beveled free ends 30 and short section beveled free ends 46 provide a smooth communication with the vegetation alongside the area covered by the apparatus for inhibiting the growth of vegetation beneath a fence 10 for better water 52 runoff.

It will be understood that each of the elements described above, or two or more together, may also find a useful application in other types of constructions differing from the types described above.

While the invention has been illustrated and described as embodied in an apparatus for inhibiting the growth of vegetation beneath a fence, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An underfence vegetation inhibiting apparatus having a length and inhibiting growth of vegetation beneath a fence having a plurality of fence posts and at least one fence panel with a bottom disposed intermediate a pair of fence posts of the plurality of fence posts, comprising:

a) a long section elongated substantially U-shaped central portion having a lower surface with ends and defining a slot for receiving the bottom of a fence panel of the at least one fence panel; said long section elongated substantially U-shaped central portion further having a long section elongated substantially flat thin bottom with sides and an entire length and a pair of long section elongated substantially flat thin sides extending upwardly along said entire length of said sides of said long section elongated substantially flat thin bottom; each of said pair of long section elongated substantially flat thin sides terminating in a long section elongated substantially flat thin side free end with an entire length;

b) a pair of long section elongated thin convex arcuate shaped portions, each of which having a lower surface with ends and extending outwardly downwardly along said entire length of each said long section elongated substantially flat thin side free end of said pair of long section elongated substantially flat thin sides of said long section elongated substantially U-shaped central portion; each said long section elongated thin convex arcuate shaped portion terminating in a long section free end; each of said long section elongated substantially U-shaped central portion and said pair of long section elongated thin convex arcuate shaped portions being one half inch thick and said ends of said lower surface of said long section elongated substantially U-shaped central portion and said ends of said lower surface of said pair of long section elongated thin convex arcuate shaped portions having a plurality of laterally disposed long section break-off slots, so that the length of said underfence vegetation inhibiting apparatus can be decreased if space intermediate the pair of fence posts of the plurality of fence posts mandates; and c) a short section having a length and being utilized to cover a gap formed at a fence post when said underfence vegetation inhibiting apparatus is utilized with more fence posts than the pair of fence posts; said short section having a short section elongated substantially U-shaped central portion with a lower surface with ends and defining a slot for receiving the bottom of the fence panel of the at least one fence panel and being received by said slot of said long section elongated substantially U-shaped central portion; said short section elongated substantially U-shaped central portion further having a short section elongated substantially flat thin bottom with sides and an entire length, and a pair of short section elongated substantially flat thin sides extending upwardly along said entire length of said sides of said short section elongated substantially flat thin bottom; each of said pair of said short section elongated substantially flat thin sides terminating in a short section elongated substantially flat thin side free end with an entire length; said short section further having a pair of short section elongated thin convex arcuate shaped portions; each of said pair of short section elongated thin convex arcuate shaped portions of said short section having a lower surface with ends and extending outwardly downwardly along said entire length of each said short section elongated substantially flat thin side free end of said pair of short section elongated substantially flat thin sides of said short section elongated substantially U-shaped central portion; each of said pair of short section elongated thin convex arcuate shaped portions terminating in a short section free end; each of said short section elongated substantially U-shaped central portion and said pair of short section elongated thin convex arcuate shaped portions being one half inch thick and said ends of said lower surface of said short section elongated substantially U-shaped central portion and said ends of said lower surface of said pair of short section elongated thin convex arcuate shaped portions having a plurality of laterally disposed short section break-off slots, so that the length of said short section can be decreased; and further, said short section elongated substantially flat thin bottom of said short section elongated substantially U-shaped central portion has a centrally disposed short section bottom aperture for receiving one of said fence posts therein; and one of said pair of short section elongated thin convex arcuate shaped portions and a respective one of said pair of short section elongated substantially flat sides have a continuous laterally disposed short section separation cut that extends from a respective said short section free end and opens into said centrally disposed short section bottom aperture.

2. The apparatus as defined in claim 1, wherein each said long section elongated thin convex arcuate shaped portion extends to a point generally below said long section elongated substantially flat thin bottom of said long section elongated substantially U-shaped central portion.

3. The apparatus as defined in claim 2, wherein said long section free end is beveled, so that smooth communication with vegetation alongside an area covered by said underfence vegetation inhibiting apparatus is provided for better water runoff.

4. The apparatus as defined in claim 3, wherein each said long section elongated thin convex arcuate shaped portion extends outwardly downwardly along said entire length of said each said long section elongated substantially flat thin side free end of said pair of long section elongated substantially flat thin sides of said long section elongated substantially U-shaped central portion at an approximate angle of 15 degrees so as to provide a spring-type loading action when said underfence vegetation inhibiting apparatus is sandwiched between a section of vegetation and the fence panel of the at least one fence panel, so that said underfence vegetation inhibiting apparatus is held in place therebetween and prevented from vertical movement due to wind.

5. The apparatus as defined in claim 4, wherein said each said long section elongated thin convex arcuate shaped portion is integrally formed with said long section elongated substantially U-shaped central portion.

6. The apparatus as defined in claim 5, wherein said each said long section elongated thin convex arcuate shaped portion is integrally formed with said long section elongated substantially U-shaped central portion by extrusion.

7. The apparatus as defined in claim 6, wherein said each said long section elongated thin convex arcuate shaped portion is integrally formed with said long section elongated substantially U-shaped central portion by extrusion of one half inch green weather resistant vinyl in a length of ten feet and a width of eight inches, so that said each said long section elongated thin convex arcuate shaped portion and said long section elongated substantially U-shaped central portion blend in with surrounding turf and are totally maintenance free.

8. The apparatus as defined in claim 1, wherein said long section elongated substantially flat thin bottom of said long section elongated substantially U-shaped central portion has at least one long section bottom spike hole and an aluminum spike is passable through said at least one long section bottom spike hole and securable in the ground underneath.

9. The apparatus as defined in claim 1, wherein said each of said pair of short section elongated thin convex arcuate shaped portions extends to a point generally below said short section elongated substantially flat thin bottom of said short section elongated substantially U-shaped central portion.

10. The apparatus as defined in claim 9, wherein said short section free end is beveled, so that smooth communication with vegetation alongside an area covered by said underfence vegetation inhibiting apparatus is provided for better water runoff.

11. The apparatus as defined in claim 10, wherein said each of said pair of short section elongated thin convex arcuate shaped portion extends outwardly downwardly along said entire length of said each said short section elongated substantially flat thin side free end of said pair of short section elongated substantially flat thin sides of said short section elongated substantially U-shaped central portion at an approximate angle of 15 degrees so as to provide a spring-type loading action when said underfence vegetation inhibiting apparatus is sandwiched between a section of vegetation and said fence panel of the at least one fence panel, so that said underfence vegetation inhibiting apparatus is held in place therebetween and prevented from vertical movement due to wind.

12. The apparatus as defined in claim 11, wherein said each of said pair of short section elongated thin convex arcuate shaped portions is integrally formed with said short section elongated substantially U-shaped central portion.

13. The apparatus as defined in claim 12, wherein said each of said pair of short section elongated thin convex arcuate shaped portion is integrally formed with said short section elongated substantially U-shaped central portion by extrusion.

14. The apparatus as defined in claim 13, wherein said each of said pair of short section elongated thin convex arcuate shaped portion is integrally formed with said short section elongated substantially U-shaped central portion by extrusion of one half inch green weather resistant vinyl in a length of two feet and a width of eight inches so that said each of said pair of short section elongated thin convex arcuate shaped portions and said short section elongated substantially U-shaped central portion blend in with surrounding turf and are totally maintenance free.

* * * * *